US011932467B2

(12) United States Patent
Ackroyd

(10) Patent No.: US 11,932,467 B2
(45) Date of Patent: Mar. 19, 2024

(54) COVER FOR TRAY WITH CONTAINERS

(71) Applicant: Graphic Packaging International, LLC, Atlanta, GA (US)

(72) Inventor: Robert Ackroyd, Leeds (GB)

(73) Assignee: Graphic Packaging International, LLC, Atlanta, GA (US)

( * ) Notice: Subject to any disclaimer, the term of this patent is extended or adjusted under 35 U.S.C. 154(b) by 2 days.

(21) Appl. No.: 17/729,171

(22) Filed: Apr. 26, 2022

(65) Prior Publication Data

US 2022/0340329 A1 Oct. 27, 2022

Related U.S. Application Data

(60) Provisional application No. 63/180,242, filed on Apr. 27, 2021, provisional application No. 63/301,594, filed on Jan. 21, 2022.

(51) Int. Cl.

| | |
|---|---|
| ***B65D 5/62*** | (2006.01) |
| ***B65D 71/12*** | (2006.01) |
| ***B65D 71/68*** | (2006.01) |

(52) U.S. Cl.

CPC ..... *B65D 5/62* (2013.01); *B65D 71/0077* (2013.01); *B65D 71/125* (2013.01)

(58) Field of Classification Search

CPC .... B65D 5/62; B65D 71/0077; B65D 71/125; B65D 5/322; B65D 5/54; B65D 5/68; B65D 2571/0066; B65D 5/4608; B65D 2571/0029; B65D 2571/0045; B65D 5/542; B65D 5/5445; B65D 2571/0037; B65D 2571/00567; B65D 2571/00666; B65D 2571/00796; B65D 5/28; B65D 77/32

USPC ..... 229/182, 125.19, 125.33, 123.2, 117.13; 206/177, 199, 427

See application file for complete search history.

(56) References Cited

U.S. PATENT DOCUMENTS

| | | | |
|---|---|---|---|
| 1,335,296 | A | 3/1920 | Postal et al. |
| D65,395 | S | 8/1924 | Connor |
| D80,092 | S | 12/1929 | Schleicher |
| D101,850 | S | 11/1936 | Bowen |
| 2,085,827 | A | 7/1937 | Perreton |
| 2,091,664 | A | 8/1937 | Walsh |

(Continued)

FOREIGN PATENT DOCUMENTS

| | | |
|---|---|---|
| BE | 904404 | 6/1986 |
| DE | 2 159 258 | 6/1973 |

(Continued)

OTHER PUBLICATIONS

International Search Report and Written Opinion for PCT/US2022/026279 dated Aug. 12, 2022.

(Continued)

*Primary Examiner* — Christopher R Demeree

(74) *Attorney, Agent, or Firm* — Womble Bond Dickinson (US) LLP

(57) ABSTRACT

A cover for at least partially overlying a tray holding one or more containers includes a central panel, at least one end flap foldably connected to the central panel, and at least one attachment flap foldably connected to the central panel, the at least one attachment flap includes a base portion and an attachment portion separably connected to the base portion, the attachment portion for being attached to a portion of the tray.

53 Claims, 6 Drawing Sheets

(56) References Cited

U.S. PATENT DOCUMENTS

| | | | |
|---|---|---|---|
| 2,281,592 | A | 5/1942 | O'Brien |
| 2,330,699 | A | 9/1943 | Flamm |
| 2,584,787 | A | 2/1952 | Castle |
| 2,611,527 | A | 9/1952 | Fisher |
| 2,823,063 | A | 2/1958 | Toensmeier |
| 2,844,245 | A | 7/1958 | Gruber et al. |
| 2,878,931 | A | 3/1959 | Stroheim |
| 2,919,844 | A | 1/1960 | Anderson, Jr. |
| 3,016,259 | A | 1/1962 | Lawrence |
| 3,075,799 | A | 1/1963 | Weiss |
| 3,118,537 | A | 1/1964 | Copping |
| 3,123,213 | A | 3/1964 | Kulig |
| 3,144,130 | A | 8/1964 | Copping |
| 3,151,802 | A | 10/1964 | Spery |
| 3,156,358 | A | 11/1964 | Randrup |
| 3,166,190 | A | 1/1965 | Conrades |
| 3,245,711 | A | 4/1966 | Dantoin |
| 3,305,085 | A | 2/1967 | Rossie |
| 3,334,734 | A | 8/1967 | Meyers |
| 3,414,313 | A | 12/1968 | Schwarz |
| 3,425,544 | A | 2/1969 | Ayer et al. |
| D220,169 | S | 3/1971 | Lundberg |
| 3,616,897 | A | 11/1971 | Vrana |
| 3,661,417 | A | 5/1972 | Inman |
| 3,675,764 | A | 7/1972 | Dutcher |
| 3,701,416 | A | 10/1972 | Lawrence |
| 3,747,750 | A | 7/1973 | Chapman |
| 3,747,835 | A | 7/1973 | Graser |
| 3,756,394 | A | 9/1973 | Huault |
| 3,767,042 | A | 10/1973 | Ganz |
| 3,780,906 | A | 12/1973 | Katzenmeyer |
| 3,881,648 | A | 5/1975 | Hall |
| 3,897,873 | A | 8/1975 | Graser |
| 3,963,121 | A | 6/1976 | Kipp |
| 3,964,607 | A | 6/1976 | Wagner |
| D241,820 | S | 10/1976 | Jewell |
| 4,029,207 | A | 6/1977 | Gordon |
| 4,139,094 | A | 2/1979 | Berry et al. |
| 4,192,540 | A | 3/1980 | Oliff |
| 4,256,226 | A | 3/1981 | Stone |
| 4,272,010 | A | 6/1981 | Capo |
| D261,235 | S | 10/1981 | McMullan |
| 4,304,329 | A | 12/1981 | Graser |
| 4,336,898 | A | 6/1982 | Joyce |
| D271,944 | S | 12/1983 | Wood |
| 4,424,901 | A | 1/1984 | Lanier |
| 4,449,744 | A | 5/1984 | Vossen |
| 4,471,870 | A | 9/1984 | Uhlig |
| D286,020 | S | 10/1986 | Barrash |
| 4,621,734 | A | 11/1986 | Heijnen et al. |
| 4,708,284 | A | 11/1987 | Sutherland et al. |
| 4,747,486 | A | 5/1988 | Benno |
| 4,754,879 | A | 7/1988 | Benno |
| 4,768,703 | A | 9/1988 | Sosler et al. |
| D297,916 | S | 10/1988 | Gloyer |
| 4,875,585 | A | 10/1989 | Kadleck et al. |
| D305,204 | S | 12/1989 | Reifein |
| D305,205 | S | 12/1989 | Grindrod |
| 4,913,291 | A | 4/1990 | Schuster |
| 4,919,266 | A | 4/1990 | McIntosh, Jr. |
| 4,925,019 | A | 5/1990 | Ganz et al. |
| D319,388 | S | 8/1991 | McIntosh, Jr. |
| 5,042,660 | A | 8/1991 | Carver |
| 5,058,735 | A | 10/1991 | Bienaime |
| D321,456 | S | 11/1991 | Wolff |
| D322,571 | S | 12/1991 | Groves |
| 5,103,971 | A | 4/1992 | Schuster |
| 5,135,104 | A | 8/1992 | Jorba |
| 5,163,548 | A | 11/1992 | Domansky |
| D334,498 | S | 4/1993 | Romme |
| 5,201,412 | A | 4/1993 | Schuster et al. |
| D335,442 | S | 5/1993 | Detert |
| D335,445 | S | 5/1993 | Detert |
| D335,820 | S | 5/1993 | Detert |
| D335,821 | S | 5/1993 | Detert |
| D336,241 | S | 6/1993 | Detert |
| D336,242 | S | 6/1993 | Detert |
| D337,048 | S | 7/1993 | Detert |
| D337,268 | S | 7/1993 | Detert |
| D340,411 | S | 10/1993 | Ong |
| 5,297,673 | A | 3/1994 | Sutherland |
| 5,351,815 | A | 10/1994 | Fogle et al. |
| 5,355,999 | A | 10/1994 | Sutherland |
| 5,364,333 | A | 11/1994 | Gulliver et al. |
| 5,377,862 | A | 1/1995 | Oakes et al. |
| 5,400,901 | A | 3/1995 | Harrelson |
| 5,415,278 | A | 5/1995 | Sutherland |
| 5,445,262 | A | 8/1995 | Sutherland |
| 5,485,915 | A | 1/1996 | Harris |
| 5,549,197 | A | 8/1996 | Sutherland |
| 5,590,776 | A | 1/1997 | Galbierz |
| 5,595,291 | A | 1/1997 | Negelen |
| 5,609,251 | A | 3/1997 | Harris |
| D394,385 | S | 5/1998 | Laughlin |
| 5,775,503 | A | 7/1998 | LeBras |
| 5,813,540 | A | 9/1998 | Vollbrecht et al. |
| 5,845,776 | A | 12/1998 | Galbierz |
| 5,853,088 | A | 12/1998 | Saulas et al. |
| D408,282 | S | 4/1999 | McCann |
| 5,921,392 | A | 7/1999 | Davis |
| 5,941,389 | A | 8/1999 | Gomes |
| 5,975,287 | A | 11/1999 | Negelen |
| D434,256 | S | 11/2000 | Shimbo |
| 6,223,892 | B1 | 5/2001 | Bakx |
| 6,371,365 | B1 | 4/2002 | Doucette et al. |
| 6,378,697 | B1 | 4/2002 | Sutherland et al. |
| 6,422,453 | B1 | 7/2002 | Wang |
| 6,488,322 | B2 | 12/2002 | Bakx |
| D470,412 | S | 2/2003 | Palmer-Ball |
| 6,658,815 | B1 | 12/2003 | Gaspar |
| 6,814,228 | B2 | 11/2004 | Sutherland |
| 6,869,009 | B2 | 3/2005 | Sutherland et al. |
| 6,877,600 | B2 | 4/2005 | Sutherland |
| 6,981,631 | B2 | 1/2006 | Fogle et al. |
| D525,866 | S | 8/2006 | Oliveira |
| D532,690 | S | 11/2006 | Oliveira |
| 7,175,020 | B2 | 2/2007 | Sutherland et al. |
| 7,374,038 | B2 | 5/2008 | Smalley |
| 7,617,969 | B2 | 11/2009 | Oliveira |
| D608,637 | S | 1/2010 | Getsy |
| 7,703,665 | B2 | 4/2010 | McGowan |
| 7,766,181 | B2 | 8/2010 | Fogle et al. |
| 7,793,779 | B2 | 9/2010 | Spivey, Sr. et al. |
| 7,793,821 | B2 | 9/2010 | Oliveira |
| 7,832,621 | B2 | 11/2010 | Smalley |
| 7,959,062 | B2 | 6/2011 | Auclair |
| 8,002,171 | B2 | 8/2011 | Ryan et al. |
| 8,100,256 | B2 | 1/2012 | Spivey, Sr. et al. |
| 8,162,135 | B2 | 4/2012 | Oliveira |
| D659,551 | S | 5/2012 | Ramirez |
| 8,225,985 | B2 | 7/2012 | Oliveira |
| D678,761 | S | 3/2013 | Cooper |
| 8,387,784 | B2 | 3/2013 | Gonzalez |
| D691,035 | S | 10/2013 | Sill |
| D693,217 | S | 11/2013 | Sill |
| D693,218 | S | 11/2013 | Sill |
| 8,602,209 | B2 | 12/2013 | Jones et al. |
| 8,622,207 | B2 | 1/2014 | Smalley |
| 9,193,521 | B2 | 11/2015 | Wilhelm |
| D758,191 | S | 6/2016 | Tu |
| 9,359,093 | B2 * | 6/2016 | DePaula ..... B65B 13/00 |
| D774,897 | S | 12/2016 | Mayer |
| D774,898 | S | 12/2016 | Mayer |
| 9,598,202 | B2 | 3/2017 | Oliveira et al. |
| D787,929 | S | 5/2017 | Sill |
| D787,933 | S | 5/2017 | Sill |
| D796,954 | S | 9/2017 | Lun |
| D816,481 | S | 5/2018 | Sill |
| D839,729 | S | 2/2019 | Oliveira |
| D853,229 | S | 7/2019 | Lebeau |
| D854,943 | S | 7/2019 | Requena |
| 10,562,686 | B2 | 2/2020 | Spivey, Sr. et al. |
| D879,606 | S | 3/2020 | Sill |
| D880,999 | S | 4/2020 | Sill |

(56) References Cited

U.S. PATENT DOCUMENTS

| | | | | |
|---|---|---|---|---|
| D976,104 | S | 1/2023 | Sill | |
| 2002/0112973 | A1 | 8/2002 | Sutherland | |
| 2004/0222127 | A1 | 11/2004 | McLeod et al. | |
| 2005/0001020 | A1 | 1/2005 | Garnier | |
| 2005/0173269 | A1 | 8/2005 | LeBras | |
| 2006/0283744 | A1 | 12/2006 | Kruit | |
| 2008/0190785 | A1 | 8/2008 | Spivey | |
| 2008/0230406 | A1 | 9/2008 | Cuomo | |
| 2008/0257942 | A1 | 10/2008 | LeBras | |
| 2010/0065618 | A1 | 3/2010 | Lechevalier et al. | |
| 2010/0078337 | A1 | 4/2010 | Sutherland | |
| 2010/0175351 | A1 | 7/2010 | Hand | |
| 2010/0264043 | A1 | 10/2010 | De Paula | |
| 2011/0016831 | A1 | 1/2011 | Huber | |
| 2011/0132978 | A1 | 6/2011 | De Sousa | |
| 2011/0226845 | A1 | 9/2011 | DePaula | |
| 2011/0284623 | A1 | 11/2011 | Jones | |
| 2012/0067755 | A1 | 3/2012 | Spivey, Sr. | |
| 2013/0256392 | A1 | 10/2013 | Kohler | |
| 2013/0292285 | A1 | 11/2013 | Kastanek | |
| 2014/0021071 | A1 | 1/2014 | Alexander | |
| 2014/0021080 | A1 | 1/2014 | Fitzwater | |
| 2014/0027318 | A1 | 1/2014 | Sutherland | |
| 2014/0042215 | A1 | 2/2014 | Sutherland | |
| 2014/0174976 | A1 | 6/2014 | Ramberg et al. | |
| 2017/0240329 | A1 | 8/2017 | Spivey, Sr. | |
| 2021/0403199 | A1* | 12/2021 | Weaver ..... | B65D 5/542 |
| 2022/0340329 | A1 | 10/2022 | Ackroyd | |

FOREIGN PATENT DOCUMENTS

| | | | |
|---|---|---|---|
| DE | 103 04 527 | | 8/2004 |
| EM | 006565271-0002 | | 7/2019 |
| EP | 0 094 806 | | 11/1983 |
| EP | 0 108 614 | | 1/1987 |
| EP | 0 406 556 | | 1/1991 |
| EP | 0 459 658 | | 12/1991 |
| FR | 2.041.931 | | 2/1971 |
| FR | 2 292 640 | | 6/1976 |
| FR | 2 412 473 | | 7/1979 |
| GB | 6206139 | | 5/2022 |
| GB | 6209060 | | 5/2022 |
| WO | WO 93/14993 | | 8/1993 |
| WO | WO 94/02380 | | 2/1994 |
| WO | WO 97/29026 | A1 | 8/1997 |
| WO | WO 99/02422 | A1 | 1/1999 |
| WO | WO 02/059011 | | 8/2002 |

OTHER PUBLICATIONS

Keelclip, available Oct. 17, 2019, [online], [site visited Jun. 13, 2023]. available from internet, URL:https://www.prnewswire.com/news-releases/graphic-packaging-international-develops-keelclip-an-innovative-paperboard-packaging-solution-for-food-and-beverage-cans-300940191.html (Year: 2019).

* cited by examiner

COVER FOR TRAY WITH CONTAINERS

CROSS-REFERENCE TO RELATED APPLICATION

This application claims the benefit of each of U.S. Provisional Patent Application No. 63/180,242, filed on Apr. 27, 2021, and U.S. Provisional Patent Application No. 63/301,594, filed on Jan. 21, 2022.

INCORPORATION BY REFERENCE

The disclosures of each of U.S. Provisional Patent Application No. 63/180,242, filed on Apr. 27, 2021, U.S. Provisional Patent Application No. 63/301,594, filed on Jan. 21, 2022, and U.S. Design patent application No. 29/821,528, filed on Dec. 30, 2021, are hereby incorporated by reference for all purposes as if presented herein in their entireties.

BACKGROUND OF THE DISCLOSURE

The present disclosure generally relates to covers for trays that hold, display, and/or transport containers.

SUMMARY OF THE DISCLOSURE

According to one aspect, the disclosure is generally directed to a cover for at least partially overlying a tray holding one or more containers, the cover comprising a central panel, at least one end flap foldably connected to the central panel, and at least one attachment flap foldably connected to the central panel, the at least one attachment flap includes a base portion and an attachment portion separably connected to the base portion, the attachment portion for being attached to a portion of the tray.

According to another aspect, the disclosure is generally directed to a blank for forming a cover for at least partially overlying a tray holding one or more containers, the blank comprising a central panel, at least one end flap foldably connected to the central panel, and at least one attachment flap foldably connected to the central panel, the at least one attachment flap includes a base portion and an attachment portion separably connected to the base portion, the attachment portion for being attached to a portion of the tray when the cover is formed from the blank.

According to another aspect, the disclosure is generally directed to a method of forming a cover for at least partially overlying a tray holding one or more containers comprises obtaining a blank comprising a central panel, at least one end flap foldably connected to the central panel, and at least one attachment flap foldably connected to the central panel, the at least one attachment flap includes a base portion and an attachment portion separably connected to the base portion, the attachment portion for being attached to a portion of the tray. The method further comprises folding the at least one end flap, and at least partially separating the at least one attachment flap from the central panel such that the at least one attachment flap is positioned for being attached to a portion of the tray.

According to another aspect, the disclosure is generally directed to a package comprising a tray holding one or more containers, and a cover at least partially overlying the tray. The cover comprises a central panel, at least one end flap foldably connected to the central panel, and at least one attachment flap foldably connected to the central panel, the at least one attachment flap includes a base portion and an attachment portion separably connected to the base portion, the attachment portion attached to a portion of the tray.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to covers for trays, packages, constructs, sleeves, cartons, or the like, for holding and displaying containers such as jars, bottles, cans, etc. The containers can be used for packaging food and beverage products, for example, beer, soft drinks, soups, beans, corn, vegetables, meat products, snack foods such as chips, nuts, candy, etc. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; composites such as paperboard; or any combination thereof.

Covers according to the present disclosure can accommodate containers of numerous different shapes. For the purpose of illustration and not for the purpose of limiting the scope of the disclosure, the following detailed description describes food or containers (e.g., lidded paperboard or aluminum containers) at least partially disposed within trays covered by the cover embodiments. In this specification, the terms "lower," "bottom," "upper," "top," "front," and "back" indicate orientations determined in relation to fully erected covers/trays/packages, etc.

As described herein, covers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
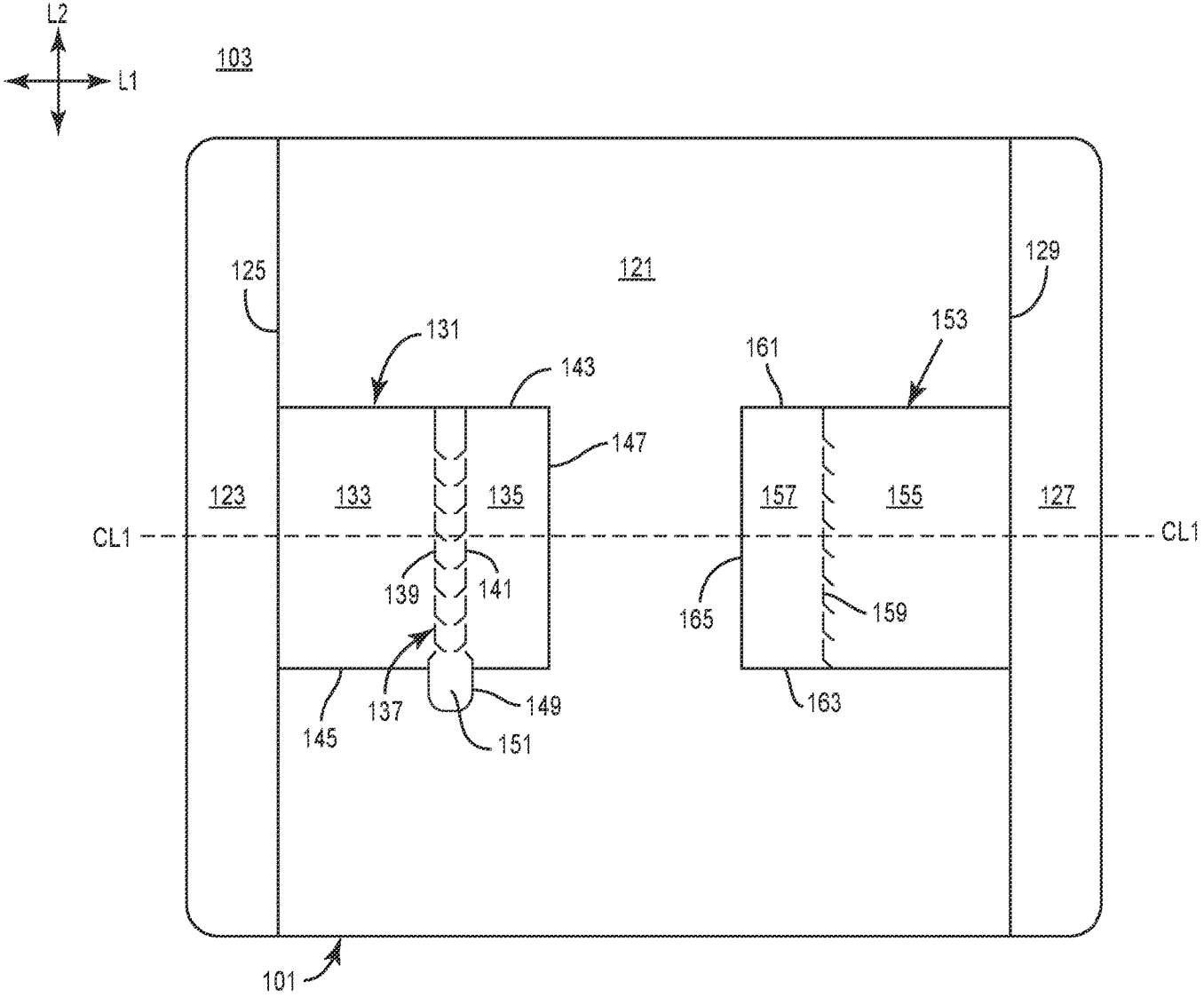
FIG. 1 is a plan view of an outer surface of a blank for forming a cover for a tray according to a first exemplary embodiment of the disclosure.

FIG. 1 shows a plan view of an exterior side 101 of a blank 103 used to form a cover 105 for a tray 107 (FIG. 2) or other construct in accordance with a first exemplary embodiment of the disclosure. The cover 105 can be sized to cover/overlie/engage a plurality of containers C held in the tray 107. In the illustrated embodiment, the containers can be snack food containers, beverage cans, or could be any other suitable type and size of container (e.g., e.g., beverage containers, cartons, etc.) without departing from the disclosure. The cover 105 can be provided together with a tray 107 and one or more containers C as package 110 (FIG. 3).

As shown in FIG. 1, the blank 103 has a longitudinal axis L1 and a lateral axis L2. The blank 103 includes at least one panel for engaging one or more containers of the plurality of containers C. In the illustrated embodiment, the blank 103 can include a top panel or central panel 121.

The blank 103 can also include a plurality of end flaps foldably connected to a respective panel of the plurality of panels. In the illustrated embodiment, the blank 103 can include a first side end flap 123 foldably connected to the central panel 121 at a lateral fold line 125, and a second side end flap 127 foldably connected to the central panel 121 at a lateral fold line 129.

A plurality of attachment flaps can be foldably connected to respective panels of the plurality of panels and/or end flaps of the plurality of end flaps of the blank 103. As shown, a first attachment flap 131 can be foldably connected to the central panel 121 and/or the first side end flap 123 at a portion of the lateral fold line 125. The first attachment flap 131 can include a base portion 133 and a distal or attachment portion 135. A tear strip 137 can be defined between a pair of spaced apart lateral lines of weakening or lateral tear lines 139, 141 (broadly, "first line of weakening" and "second line of weakening", respectively) such that the tear strip 137 is separably attached to the base portion 133 of the attachment flap 131 at the lateral tear line 139, and separably attached to the attachment portion 135 at the lateral tear line 141. In this regard, the attachment portion 135 can be separably attached to the base portion 133 of the attachment flap 131 at one or both of the tear lines 139, 141.

As also shown, the attachment flap 131 can be at least partially separable from the central panel 121 at a pair of spaced longitudinal cuts 143, 145 that extend from the fold line 125 to respective endpoints of a lateral cut 147. A generally U-shaped or other at least partially curved cut 149 can interrupt the longitudinal tear line 145 to define a tab 151 of the tear strip 137 extending away from the tear line 145.

With continued reference to FIG. 1, a second attachment flap 153 can be foldably attached to the central panel 121 and/or the second side end flap 127 at a portion of the lateral fold line 129. The second attachment flap 153 can include a base portion 155 and a distal or attachment portion 157 separably attached to the base portion 155 at a lateral line of weakening or lateral tear line 159 (broadly, "third line of weakening"). The attachment flap 153 can be at least partially separable from the central panel 121 at a pair of spaced longitudinal cuts 161, 163 that extend from the fold line 129 to respective endpoints of a lateral cut 165.

In the illustrated embodiment, the attachment flaps 131, 153 are generally aligned along a longitudinal centerline CL1 defined along the central panel 121, and which is generally parallel to the longitudinal axis L1.

It will be understood that one or both of the attachment flaps 131, 153 and associated features can have a different configuration without departing from the disclosure. For example, in one embodiment, the attachment flap 153 can be provided with a tear strip similarly to the configuration of the attachment flap 131 described above.

The blank 103 can be provided with one or more applications of an adhesive, such as glue. In the illustrated embodiment, glue can be provided on the attachment portions 135, 157 of the respective attachment flaps 131, 153 on the exterior surface 101 of the blank 103, and on portions of the side end flaps 123, 127 generally aligned with the respective attachment portion 135, 157 on an interior surface of the blank 103. The glue described herein can be, for example, a hot melt adhesive, a high tack glue, an epoxy, a polymeric cement, etc., or combinations thereof.

Figure 2:
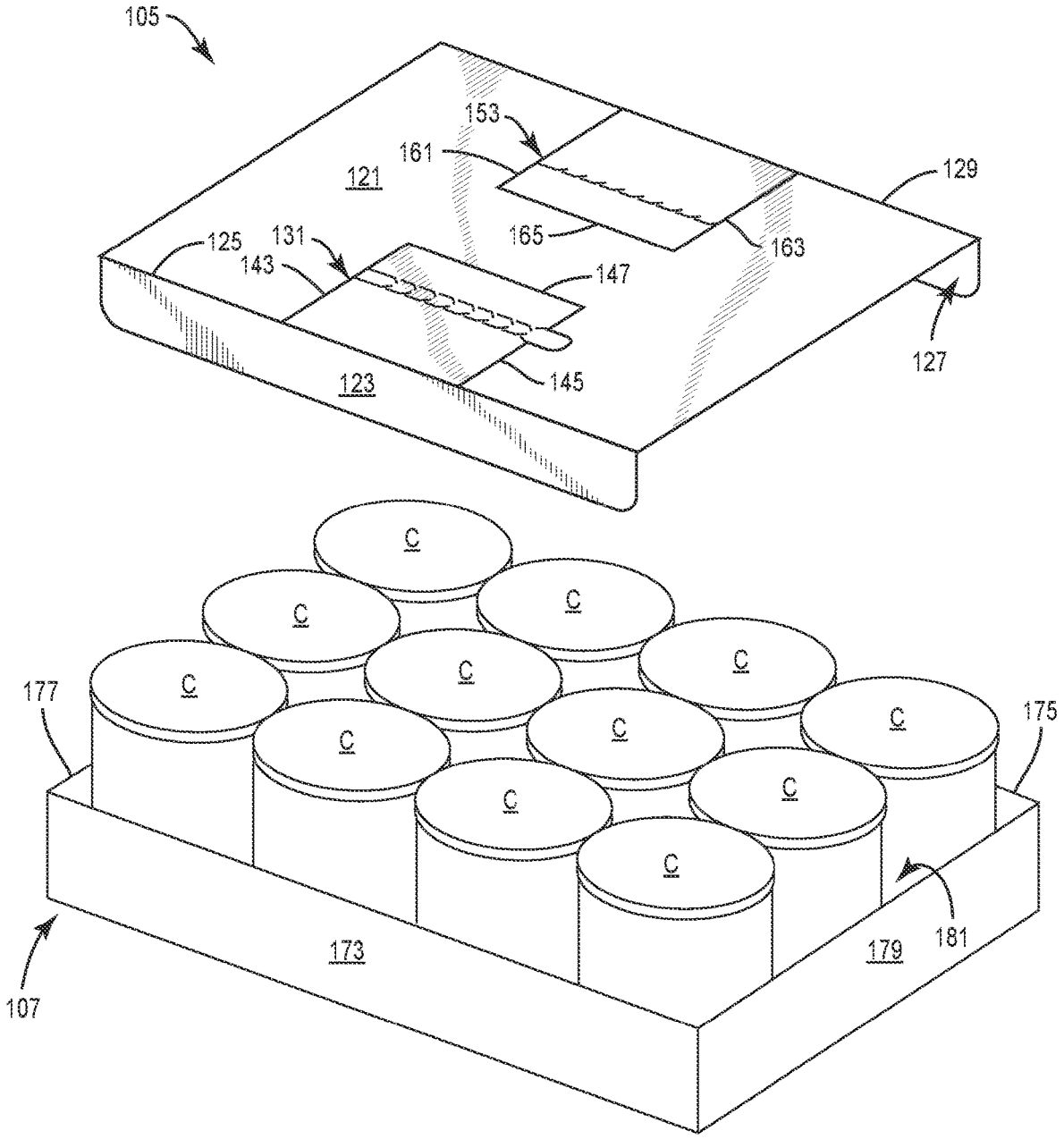
FIG. 2 is a perspective view of a cover formed from the blank of FIG. 1 above a tray holding a plurality of containers according to the first exemplary embodiment of the disclosure.
Figure 3:
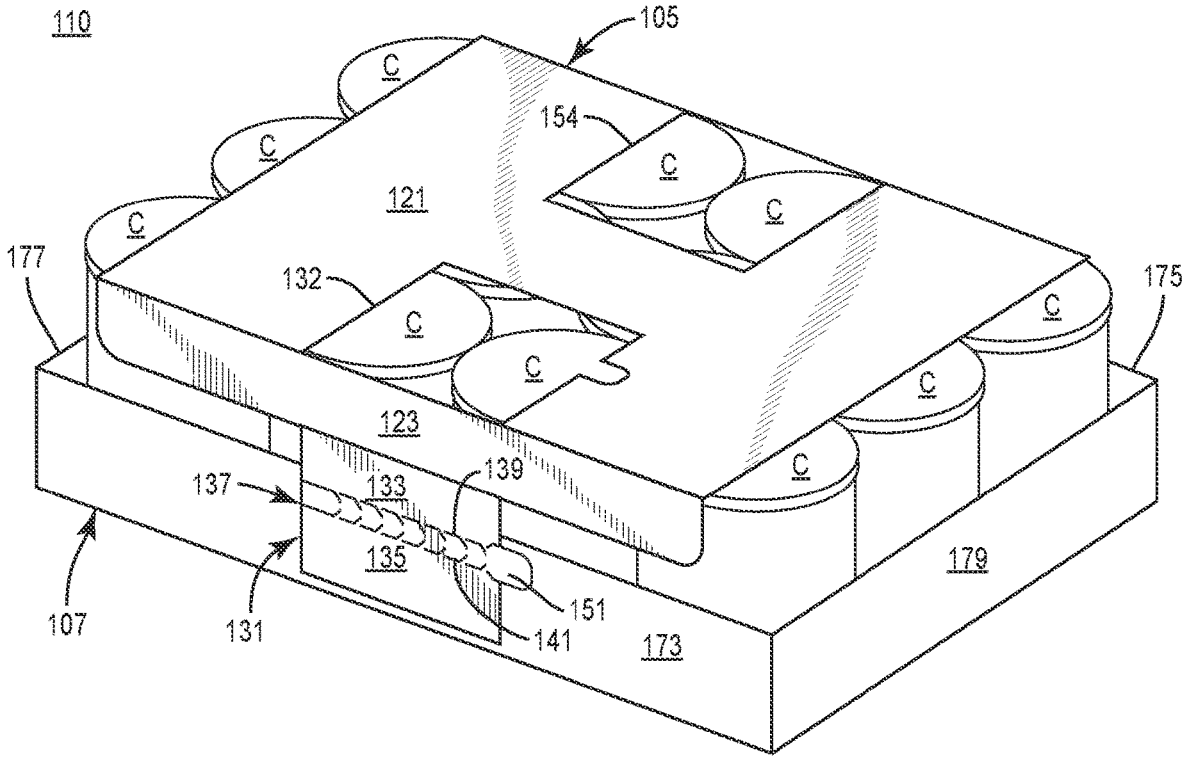
FIG. 3 is a perspective view of the cover and tray with containers of FIG. 2 attached to form a package according to the first exemplary embodiment.

Referring additionally to FIGS. 2 and 3, the cover 105 formed form the blank 103 is shown attached to the tray 107 with containers C according to the exemplary embodiment of the disclosure.

In the illustrated embodiment, the tray 107 can include a bottom/bottom panel (not shown), a pair of sidewalls/side panels 173, 175 extending upwardly from the bottom panel, and a pair of end walls/end panels 177, 179 extending upwardly from the bottom panel to define an interior 181 of the tray 107 in which the plurality of containers C are held/supported. Adjacent sidewalls/side panels and end walls/end panels of the tray 107 can be attached by associated structure, e.g., corner webs, attachment flaps, etc. It will be understood that they tray 107 can have a different shape, size, configuration, etc., without departing from the disclosure. It will be further understood that a construct different from the tray 107 can be provided for engagement with the cover 105 without departing from the disclosure.

As shown, the cover 105 can be formed and applied/attached/engaged with the tray 107 by positioning the central panel 121 over the tops of the respective containers C, e.g., so as to be generally parallel and spaced above the bottom panel 171 of the tray 107.

The side end flaps 123, 127 can be folded downwardly relative to the central panel 121 of the blank 103/cover 105 at the respective fold lines 125, 129 so as to be generally perpendicular to the central panel 121 and so as to be generally parallel to the respective side panels 173, 175 of the tray 107.

Simultaneously or thereafter, the attachment flap 131 can be separated from the central panel 121 at the respective cuts 143, 145, 147 and folded downwardly at the respective portion of the fold line 125. Such movement of the attachment flap 131 can cause a portion of the base portion 133 to overlap and adhere to the side end flap 123 with glue with the remainder of the base portion 133, the tear strip 137, and the attachment portion 135 extending downwardly therefrom.

Similarly, the attachment flap 153 can be separated from the central panel 121 at the respective cuts 161, 163, 165 and folded downwardly at the respective portion of the fold line 129 such that a portion of the base portion 155 is overlapped and adhered to the side end flap 127, with the attachment portion 157 extending downwardly therefrom.

As shown, the separation of the attachment flaps 131, 153 from the central panel 121 can form respective openings 132, 154 in the central panel 121, and which are also aligned along the longitudinal centerline CL1 of the central panel 121.

In such an arrangement, the cover 105 can be lowered further toward the tray 107 until the attachment portions 135, 157 are at least partially aligned with the respective side panels 173, 175 of the tray. Thereafter, the attachment portions 135, 137 can be attached, e.g., adhered via glue, to the respective side panels 173, 175 to attach the cover 105 to the tray 107.

The aforementioned attachment of the cover 105 to the tray 107 can provide an arrangement such that a generally low clearance is provided between the tops of the containers C supported by the tray 107 and the central panel 121 of the cover 105. In this regard, the cover 105 can maintain the position/arrangement, e.g., upright, packed, nested, etc., of the containers C in the tray 105 for shipping, transport, storage etc.

In one embodiment, a user engagement feature 167 is defined in the central panel 121 between the openings 132, 154 when the attachment flaps 131, 153 are separated from the central panel 121. The user engagement feature 167 can have the configuration of a handle or other grasping structure for grasping, lifting, carrying, or otherwise manipulating the combined cover 105/tray 107.

When it is desired to detach/uncouple the cover 105 from the tray 107, e.g., at a retail location or point of sale, in one embodiment, an operator can engage the tear strip 137 of the attachment flap 131, e.g., by grasping the tab 151, and pulling the tear strip 137 to separate from the base portion 133 and the attachment portion 135 of the attachment flap 131 at the tear lines 139, 141. In such an arrangement, the attachment portion 135 of the attachment flap 131 can remain attached/adhered to the side panel 173 of the tray 107, and the remainder of the cover 105 can be free to move at least partially away therefrom. For example, in one embodiment, the side end flap 123, the base portion 133 of the attachment flap 131, and the central panel 121 of the cover 105 can be at least partially moved/flipped over the tops of the containers C in the tray 107 so as to expose the containers C for unpacking.

Figure 4:
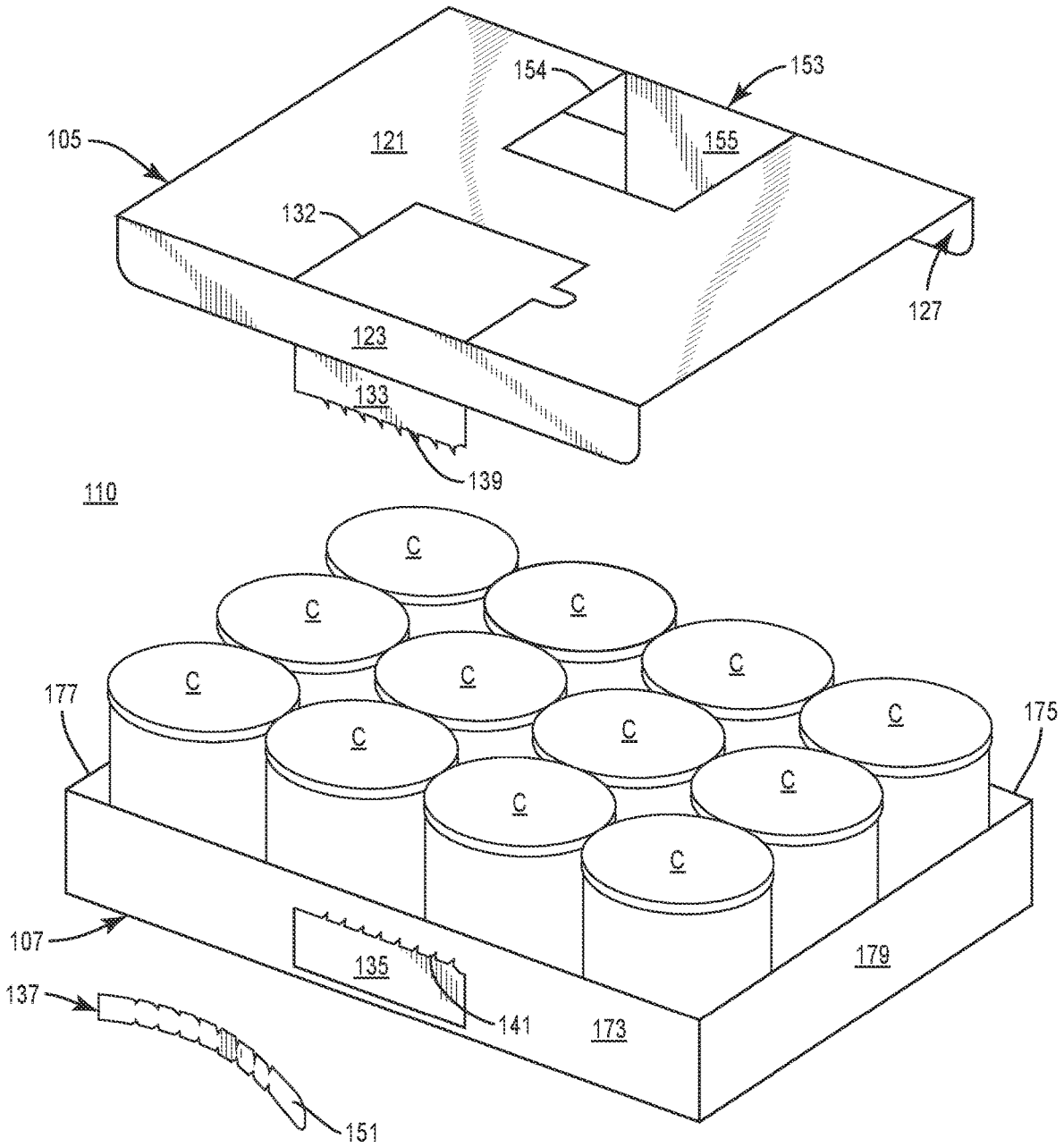
FIG. 4 is a perspective view of the tray and containers of FIG. 3 with the cover separated therefrom.

As best shown in FIG. 4, the cover 105 can be further/fully removed from the tray 107 by separating the base portion 155 of the attachment flap 153 from the attachment portion 157 at the tear line 159. In such an arrangement, the central panel 121, side end flaps 123, 127 and base portions 133, 155 of the respective attachment flaps 131, 153 can be fully removed/separated from the tray 107, with the attachment portions 135, 157 remaining attached thereto. Such disengagement of the cover 105 from the tray 107 can facilitate removal of the containers C from the tray 107, and/or can expose the containers C and the tray 107 for presentation as a retail item.

In view of the foregoing, the cover 105 can be configured/adapted for attachment to a tray 107 or other construct for holding containers C, which can be provided together as a package 110. The cover 105 can include attachment features to facilitate attachment of the cover 105 to the tray 107, such as one or more portions of the respective flaps 131, 153 and the side end flaps 123, 143. The cover 105 can also include one or more separation features to facilitate separation of the cover 105 from the tray 107, such as one or more of the tear strip 137, tear lines 139, 141, and tear line 159.

Figure 5:
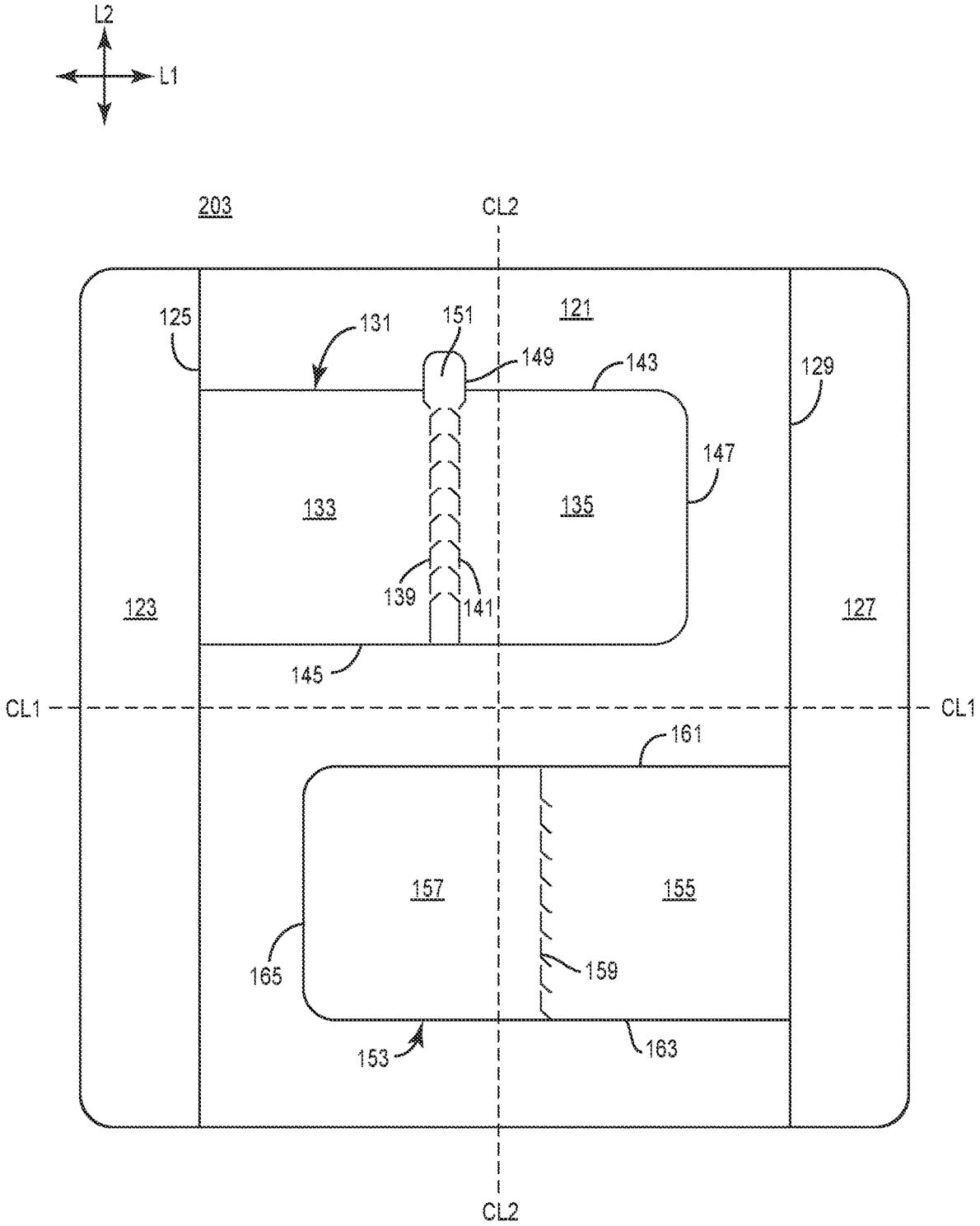
FIG. 5 is a plan view of an outer surface of a blank for forming a cover for a tray according to a second exemplary embodiment of the disclosure.

Turning to FIG. 5, a blank for forming a cover 205 (FIG. 6) according to a second exemplary embodiment of the disclosure is generally designated 203. The blank 203 and cover 205 can have one or more features similar to those described above with regard to the blank 103 and cover 105, and like are similar features are designated with like or similar reference numerals.

As shown in FIG. 5, the blank 203 includes the has a longitudinal axis L1 and a lateral axis L2. The blank 103 includes the top panel or central panel 121, the first side end flap 123, the second side end flap 127, and the attachment flaps 131, 153 and associated features. However, the attachment flaps 131, 153 can be positioned laterally offset from one another and from the longitudinal centerline CL1 of the central panel 121, as shown. In one embodiment, the attachment flaps 131, 153 can be spaced apart from the longitudinal centerline CL1 of the central panel 121.

In this regard, the attachment flaps 131, 153 can have a length in the longitudinal direction that is greater than that described above with regard to the attachment flaps 131, 153 of the blank 103/cover 105.

Figure 6:
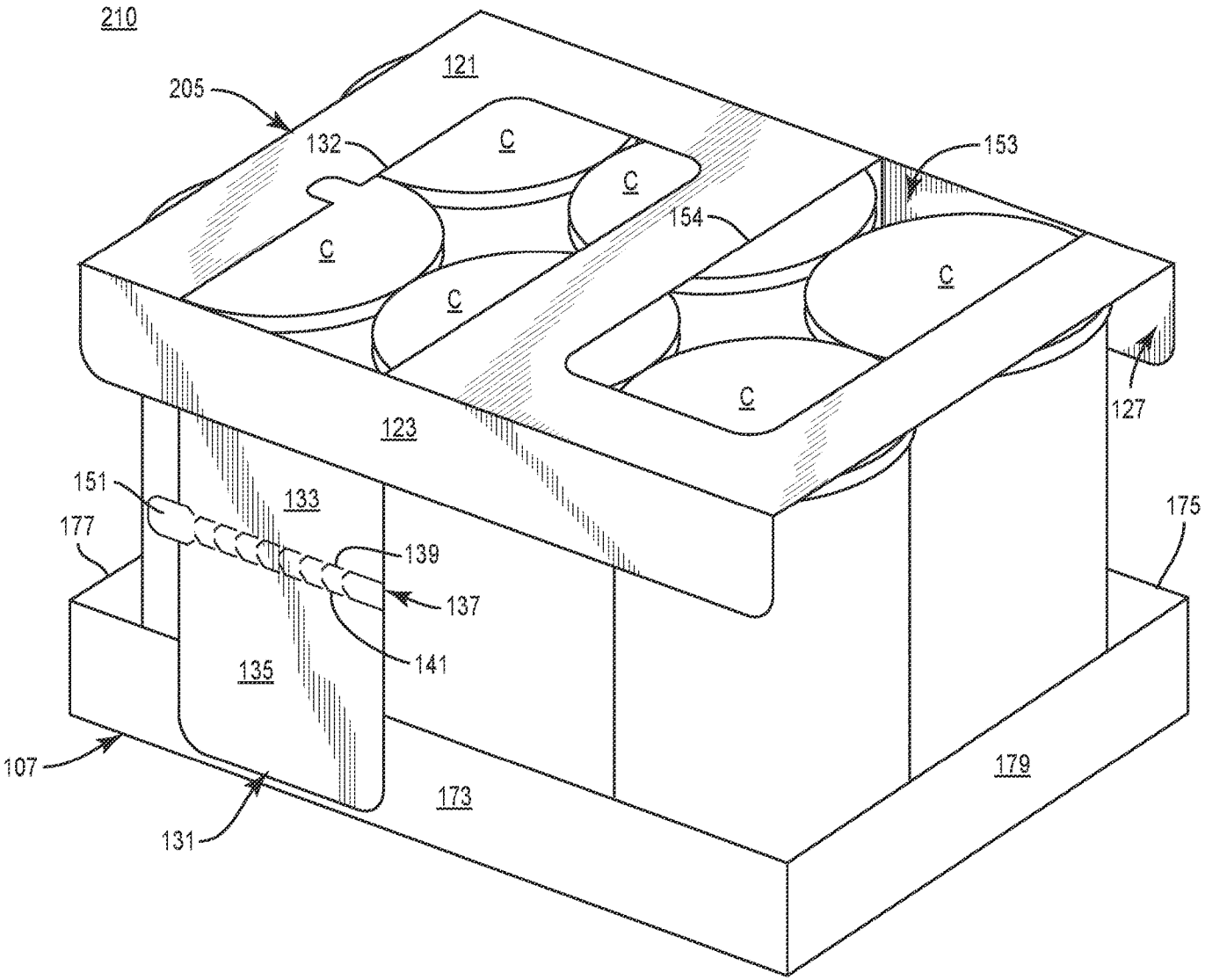
FIG. 6 is a perspective view of a cover formed from the blank of FIG. 5 and attached to a tray with containers to form a package according to the second exemplary embodiment.

With additional reference to FIG. 6, the cover 205 can be formed from the blank 203 in a manner similar to that described above with regard to the cover 105, with the openings 132, 154 formed by the separation of the central panel 121 offset from one another along the longitudinal centerline CL1. Furthermore, the openings 132, 154 can be positioned so as to intersect a lateral centerline CL2 of the central panel 121.

The cover 205 can be attached/removed from the tray 107 in a manner similar to that described above with regard to the cover 105 to form a package 210. However, owing to the generally longer attachment flaps 131, 153 of the cover 205, the cover can be configured to engage the tray 107 holding containers C that are taller than those described above with regard to the cover 105.

It will be understood that one or more portions of the blank 103/cover 105 and/or the blank 203/cover 205 can have a different configuration, shape, arrangement, etc., without departing from the disclosure.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As described herein, a line of weakening can include one or more of tear lines, cut lines, etc. As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding thereal-ong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A cover for at least partially overlying a tray holding one or more containers, the cover comprising:

a central panel;

at least one end flap foldably connected to the central panel; and at least one attachment flap foldably connected to the central panel and at least partially separated from the central panel to at least partially define an opening in the central panel, the at least one attachment flap includes a base portion and an attachment portion separably connected to the base portion, the attachment portion for being attached to a portion of the tray.

2. The cover of claim 1, wherein the attachment portion of the at least one attachment flap is for being adhered to the tray.

3. The cover of claim 2, wherein the at least one attachment flap overlaps a portion of the at least one end flap.

4. The cover of claim 1, wherein the attachment portion of the at least one attachment flap is separably connected to the base portion of the at least one attachment flap at a line of weakening.

5. The cover of claim 4, wherein the line of weakening is a first line of weakening, and the at least one attachment flap further comprises a second line of weakening spaced apart from the first line of weakening such that a tear strip is defined between the first line of weakening and the second line of weakening.

6. The cover of claim 1, wherein the at least one attachment flap is a first attachment flap, the cover further comprises a second attachment flap foldably connected to the central panel, and the second attachment flap comprises a base portion and an attachment portion separably connected to the base portion of the second attachment flap.

7. The cover of claim 6, wherein the attachment portion of the second attachment flap is for being adhered to the tray.

8. The cover of claim 7, wherein the attachment portion of the first attachment flap is separably connected to the base portion of the at least one attachment flap at a plurality of lines of weakening comprising a first line of weakening spaced apart from a second line of weakening, and the attachment portion of the second attachment flap is separably connected to the base portion of the second attachment flap at a third line of weakening.

9. The cover of claim 8, wherein a tear strip is defined between the first line of weakening and the second line of weakening.

10. The cover of claim 6, wherein the first attachment flap is aligned with the second attachment flap along a longitudinal centerline of the central panel.

11. The cover of claim 10, wherein the first attachment flap is offset from the second attachment flap along the longitudinal centerline of the central panel.

12. The cover of claim 11, wherein the opening in the central panel is a first opening in the central panel and the second attachment flap is at least partially separated from the central panel to at least partially define a second opening in the central panel, each of the first opening and the second opening intersects a lateral centerline of the central panel.

13. The cover of claim 6, wherein the opening in the central panel is a first opening in the central panel and the second attachment flap is at least partially separated from the central panel to at least partially define a second opening in the central panel, a handle engagement portion of the central panel is defined between the first opening and the second opening.

14. The tray of claim 1, wherein the at least one attachment flap is positioned in at least partial face-to-face contact with the at least one end flap.

15. A blank for forming a cover for at least partially overlying a tray holding one or more containers, the blank comprising:

a central panel;

at least one end flap foldably connected to the central panel; and at least one attachment flap foldably connected to the central panel and at least partially separable from the central panel for at least partially defining an opening in the central panel when the cover is formed from the blank, the at least one attachment flap includes a base portion and an attachment portion separably connected to the base portion, the attachment portion for being attached to a portion of the tray when the cover is formed from the blank.

16. The blank of claim 15, wherein the at least one attachment flap is for overlapping a portion of the at least one end flap when the tray is formed from the blank.

17. The blank of claim 15, wherein the attachment portion of the at least one attachment flap is separably connected to the base portion of the at least one attachment flap at a line of weakening.

18. The blank of claim 17, wherein the line of weakening is a first line of weakening, and the at least one attachment flap further comprises a second line of weakening spaced apart from the first line of weakening such that a tear strip is defined between the first line of weakening and the second line of weakening.

19. The blank of claim 15, wherein the at least one attachment flap is a first attachment flap, the cover further comprises a second attachment flap foldably connected to the central panel, and the second attachment flap comprises a base portion and an attachment portion separably connected to the base portion of the second attachment flap.

20. The blank of claim 19, wherein the attachment portion of the first attachment flap is separably connected to the base portion of the at least one attachment flap at a plurality of lines of weakening comprising a first line of weakening spaced apart from a second line of weakening, and the attachment portion of the second attachment flap is separably connected to the base portion of the second attachment flap at a third line of weakening.

21. The blank of claim 20, wherein a tear strip is defined between the first line of weakening and the second line of weakening.

22. The blank of claim 19, wherein the first attachment flap is aligned with the second attachment flap along a longitudinal centerline of the central panel.

23. The blank of claim 22, wherein the first attachment flap is offset from the second attachment flap along the longitudinal centerline of the central panel.

24. The blank of claim 23, wherein the first attachment flap and the second attachment flap intersect a lateral centerline of the central panel.

25. The blank of claim 19, wherein, a handle engagement portion of the central panel is defined between the first attachment flap and the second attachment flap.

26. The blank of claim 15, wherein the at least one attachment flap is for being positioned in at least partial face-to-face contact with the at least one end flap when the cover is formed from the blank.

27. A method of forming a cover for at least partially overlying a tray holding one or more containers, the method comprising:

obtaining a blank comprising a central panel, at least one end flap foldably connected to the central panel, and at least one attachment flap foldably connected to the central panel, the at least one attachment flap includes a base portion and an attachment portion separably connected to the base portion, the attachment portion for being attached to a portion of the tray;

folding the at least one end flap; and at least partially separating the at least one attachment flap from the central panel such that the at least one attachment flap is positioned for being attached to a portion of the tray and such that an opening is at least partially defined in the central panel.

28. The method of claim 27, further comprising adhering the at least one attachment flap to the tray.

29. The method of claim 28, wherein at least partially separating the at least one attachment flap from the central panel comprises positioning the at least one attachment flap overlapping a portion of the at least one end flap.

30. The method of claim 27, wherein the attachment portion of the at least one attachment flap is separably connected to the base portion of the at least one attachment flap at a line of weakening.

31. The method of claim 30, wherein the line of weakening is a first line of weakening, and the at least one attachment flap further comprises a second line of weakening spaced apart from the first line of weakening such that a tear strip is defined between the first line of weakening and the second line of weakening.

32. The method of claim 27, wherein the at least one attachment flap is a first attachment flap, the cover further comprises a second attachment flap foldably connected to the central panel, and the second attachment flap comprises a base portion and an attachment portion separably connected to the base portion of the second attachment flap.

33. The method of claim 32, further comprising adhering the attachment portion of the second attachment flap to the tray.

34. The method of claim 32, wherein the attachment portion of the first attachment flap is separably connected to the base portion of the at least one attachment flap at a plurality of lines of weakening comprising a first line of weakening spaced apart from a second line of weakening, and the attachment portion of the second attachment flap is separably connected to the base portion of the second attachment flap at a third line of weakening.

35. The method of claim 34, wherein a tear strip is defined between the first line of weakening and the second line of weakening.

36. The method of claim 32, wherein the first attachment flap is aligned with the second attachment flap along a longitudinal centerline of the central panel.

37. The method of claim 36, wherein the first attachment flap is offset from the second attachment flap along the longitudinal centerline of the central panel.

38. The method of claim 37, wherein the opening in the central panel is a first opening in the central panel and the method comprises at least partially separating the second attachment flap from the central panel to at least partially define a second opening in the central panel, each of the first opening and the second opening intersects a lateral centerline of the central panel.

39. The method of claim 32, wherein the opening in the central panel is a first opening in the central panel and the method comprises at least partially separating the second attachment flap from the central panel to at least partially define a second opening in the central panel, a handle engagement portion of the central panel is defined between the first opening and the second opening.

40. A package comprising:

a tray holding one or more containers; and a cover at least partially overlying the tray, the cover comprising:

a central panel;

at least one end flap foldably connected to the central panel and at least partially separated from the central panel to at least partially define an opening in the central panel; and at least one attachment flap foldably connected to the central panel, the at least one attachment flap includes a base portion and an attachment portion separably connected to the base portion, the attachment portion attached to a portion of the tray.

41. The package of claim 40, wherein the attachment portion of the at least one attachment flap is adhered to the portion of the tray.

42. The package of claim 41, wherein the at least one attachment flap overlaps a portion of the at least one end flap.

43. The package of claim 40, wherein the attachment portion of the at least one attachment flap is separably connected to the base portion of the at least one attachment flap at a line of weakening.

44. The package of claim 43, wherein the line of weakening is a first line of weakening, and the at least one attachment flap further comprises a second line of weakening spaced apart from the first line of weakening such that a tear strip is defined between the first line of weakening and the second line of weakening.

45. The package of claim 40, wherein the at least one attachment flap is a first attachment flap, the cover further comprises a second attachment flap foldably connected to the central panel, and the second attachment flap comprises a base portion and an attachment portion separably connected to the base portion of the second attachment flap.

46. The package of claim 45, wherein the attachment portion of the second attachment flap is adhered to the tray.

47. The package of claim 45, wherein the attachment portion of the first attachment flap is separably connected to the base portion of the at least one attachment flap at a plurality of lines of weakening comprising a first line of weakening spaced apart from a second line of weakening, and the attachment portion of the second attachment flap is separably connected to the base portion of the second attachment flap at a third line of weakening.

48. The package of claim 47, wherein a tear strip is defined between the first line of weakening and the second line of weakening.

49. The package of claim 45, wherein the first attachment flap is aligned with the second attachment flap along a longitudinal centerline of the central panel.

50. The package of claim 49, wherein the first attachment flap is offset from the second attachment flap along the longitudinal centerline of the central panel.

51. The package of claim 50, wherein the opening in the central panel is a first opening in the central panel and the second attachment flap is at least partially separated from the central panel to at least partially define a second opening in the central panel, each of the first opening and the second opening intersects a lateral centerline of the central panel.

52. The package of claim 45, wherein the opening in the central panel is a first opening in the central panel and the second attachment flap is at least partially separated from the central panel to at least partially define a second opening in the central panel, a handle engagement portion of the central panel is defined between the first opening and the second opening.

53. The package of claim 40, wherein the at least one attachment flap is positioned in at least partial face-to-face contact with the at least one end flap.

* * * * *